US009890547B1

(12) United States Patent
Sirco

(10) Patent No.: US 9,890,547 B1
(45) Date of Patent: Feb. 13, 2018

(54) POOL SKIMMER MOUNTING ARRANGEMENTS AND METHODS FOR INSTALLING A POOL SKIMMER

(71) Applicant: Trojan Leisure Products, LLC, Albany, NY (US)

(72) Inventor: Collin J. Sirco, Ballston Lake, NY (US)

(73) Assignee: Trojan Leisure Products, LLC, Albany, NY (US)

( * ) Notice: Subject to any disclaimer, the term of this patent is extended or adjusted under 35 U.S.C. 154(b) by 81 days.

(21) Appl. No.: 14/642,425

(22) Filed: Mar. 9, 2015

Related U.S. Application Data

(60) Provisional application No. 61/950,524, filed on Mar. 10, 2014.

(51) Int. Cl.
*E04H 4/04* (2006.01)
*E04H 4/14* (2006.01)
*E04H 4/12* (2006.01)

(52) U.S. Cl.
CPC ..... *E04H 4/1272* (2013.01)

(58) Field of Classification Search
CPC .... E04H 4/1272; E04H 4/1236; E04H 4/1218
USPC ..... 210/167.1, 167.12, 167.19; 4/496, 4/506–512; D23/209–210; 52/169.7, 52/217, 404.2; 277/606, 640; 138/112
See application file for complete search history.

(56) References Cited

U.S. PATENT DOCUMENTS 4,126,925 A * 11/1978 Jacuzzi ..... E04H 4/1272 210/167.1
4,426,286 A * 1/1984 Puckett ..... E04H 4/1272 210/121
4,649,579 A * 3/1987 Blais ..... E04H 4/1227 137/404

(Continued)

FOREIGN PATENT DOCUMENTS

EP 2014849 * 5/2008 ..... E04H 4/12

OTHER PUBLICATIONS

Model SP1084 Series Auto-SkimTM Automatic Surface Skimmer Onmer's Manuaul, Hayward Pool Products of Elizabeth, New Jersey, 8 pages, 2011.

(Continued)

*Primary Examiner* — Erin Deery
*Assistant Examiner* — Nicholas Ros
(74) *Attorney, Agent, or Firm* — Tech Valley Patent, LLC; John Pietrangelo

(57) ABSTRACT

Mounting arrangements for pool skimmers, methods for mounting pool skimmers, pool skimmer adapter plates, and pool skimmer installation kits are provided that provide unique opportunities to overcome the limitations of the prior art. Aspects of the invention include an external adapter plate having an internal cavity sized to receive an inlet of a pool skimmer assembly and an internal adapter plate having an internal cavity positioned to at least partially align with an inlet opening of the inlet of the pool skimmer assembly. The use of the adapter plates allows the pool designer and installer broad latitude in selecting a proper skimmer assembly with minimal if any impact upon the design of the pool wall or panel used. Aspects of the invention are uniquely adapted to panel-type pool construction, but may be adaptable for any pool skimmer installation.

17 Claims, 9 Drawing Sheets

(56) References Cited

U.S. PATENT DOCUMENTS

| | | | | |
|---|---|---|---|---|
| 5,195,191 | A * | 3/1993 | Stefan | E04H 4/1272 4/496 |
| 6,458,270 | B1 * | 10/2002 | Watson | E04H 4/1272 210/167.1 |
| 7,309,443 | B2 * | 12/2007 | Kelty | E04H 4/1272 210/167.1 |
| 7,914,009 | B1 * | 3/2011 | Gerspach | E04H 4/1272 277/609 |
| 2008/0216877 | A1 * | 9/2008 | Lawson | E04H 4/0025 134/111 |
| 2011/0296601 | A1 * | 12/2011 | Hodak | E04H 4/14 4/295 |

OTHER PUBLICATIONS

Model SP1084B skimmer gasket provided by Hayward Pool Products of Elizabeth, New Jersey, 1 page, undated.
Model SP1091 Series Dyna-SkimTM Automatic Skimmer Owner's Manual, Hayward Pool Products of Elizabeth, New Jersey, 4 pages, undated.
Model SPX1091G butterfly-type gasket provided by Hayward Pool Products [0065] of Elizabeth, New Jersey, 1 page, undated.
Pentair Bermuda Vinyl Skimmer Installation and User's Guide, 14 pages, 2014.
Swimline Model 8940 Skimmer Installation Instructions, 3 pages, 2009.

* cited by examiner 175
104
105

176
178
179
108
177
105
104
173
105
174

POOL SKIMMER MOUNTING ARRANGEMENTS AND METHODS FOR INSTALLING A POOL SKIMMER

CROSS-REFERENCE TO RELATED APPLICATIONS

This application claims priority from U.S. Provisional Patent Application 61/950,524, filed on Mar. 10, 2014, the disclosure of which is included by reference herein in its entirety.

BACKGROUND OF THE INVENTION

Technical Field

The present invention generally relates to swimming pool skimmer installations, and, in particular, to swimming pool skimmer mounting arrangements, methods for installing swimming pool skimmers, swimming pool skimmer mounting adapter plates, and swimming pool skimmer installation kits.

Description of Related Art

Swimming pool skimmers are a common feature of substantially every public or private swimming pool. Swimmers are likely familiar with the recesses in the side of a swimming pool that provide access to the skimmer proper, which includes a collection basket for debris and a return conduit to the pool's filtration system. As is known in the art, the conventional pool skimmer provides a convenient and effective means for regulating the presence of debris in the pool and, hence, enhancing sanitation and bather safety.

As is known in the art, various suppliers provide skimmer assemblies having an varyingly sized pool water inlets, filter baskets, and assorted conduits adapted to be plumbed to the filtration system. The size and shape of these typical aftermarket skimmer assemblies can vary broadly depending upon, among other things, the manufacturer, the flow capacity, and the details of the installation. For the typical aboveground, backyard pool with a conventional vinyl liner, the installation of the skimmer assembly typically requires that the installer provide a hole in the liner to accommodate the size and dimensions of the skimmer assembly being installed.

However, the fabrication and installation of "panel type" pools do not lend themselves to simple on-site cutting of the pool panel or wall in order to accommodate the size and shape of the skimmer assembly being installed. Panel type pool construction, for example, the insulated-panel type pool construction that characterizes the leading suppliers in the field, for example, Radiant Pools of Albany N.Y., provide pre-cut perforations or through holes for skimmer installation in prefabricated panel units. Since the required size and shape of these pre-cut through holes may vary depending upon the skimmer assembly being used, the present invention was developed to facilitate pool skimmer installation and to provide flexibility in the selection of skimmer assemblies when designing and installing skimmer assemblies for pools.

Aspects of the present invention overcome the disadvantages of the prior art skimmer installations by providing swimming pool skimmer mounting arrangements, methods for installing swimming pool skimmers, swimming pool skimmer mounting adapter plates, and swimming pool skimmer installation kits that are easier to adapt to varying skimmer sizes and shapes.

SUMMARY OF THE INVENTION

After experiencing the inconveniences that characterize prior art skimmer installations and their methods of installation, the present inventor provides the following improvements.

According to one embodiment of the invention, a pool skimmer mounting arrangement is provided. The pool skimmer mounting arrangement includes or comprises an external adapter plate adapted to mount on an external surface of a pool wall about a penetration in the pool wall, the external adapter plate having an internal cavity sized to receive an inlet of a pool skimmer assembly and having a plurality of through holes positioned to receive a plurality of mechanical fasteners; and an internal adapter plate adapted to mount on an internal surface of a pool wall about the penetration in the pool wall, the internal adapter plate having an internal cavity positioned to at least partially align with an inlet opening of the inlet of the pool skimmer assembly and a plurality of through holes positioned to receive the plurality of mechanical fasteners. In one aspect of this invention, the internal cavity of the external adapter plate or of the internal adapter plate comprises an open internal cavity. In another aspect, the internal cavity of the internal adapter plate may be adapted to substantially completely align with the opening of the inlet of the pool skimmer assembly.

In another aspect of the invention, the plurality of through holes in the external adapter plate comprise a plurality of elongated through holes, for example, to facilitate installation. The elongated through holes may have a major axis at least 20% greater than the hole's minor axis.

In another aspect, the mounting arrangement is uniquely adapted for use with pool walls having a thickness, and wherein the penetration extends through the thickness of the pool wall. For example, in one aspect, the pool wall thickness may be at least ⅛ inch, or at least ¼, or at least ½ inch, but may range from about 1 inch to about 3 inches.

Another embodiment of the invention is a method of installing a pool skimmer assembly on a wall of a pool, the method including or comprises positioning an internal adapter plate on an internal surface of the pool wall about a penetration in the pool wall, the internal adapter plate having an internal cavity positioned to at least partially align with an inlet opening of an inlet of the pool skimmer assembly and a plurality of through holes positioned to receive a plurality of mechanical fasteners; inserting the inlet of the pool skimmer assembly into the penetration; and securing the inlet of the pool skimmer assembly to the internal adapter plate with the plurality of fasteners. In one aspect, the method may further include positioning an external adapter plate on an external surface of the pool wall about the penetration in the pool wall, the external adapter plate having an internal cavity sized to receive the inlet of a pool skimmer assembly and having a plurality of through holes positioned to receive a plurality of mechanical fasteners, and engaging the through holes of the external adapter plate with the through holes of the internal adapter plate with the plurality of mechanical fasteners.

In another aspect, the method may further include, prior to inserting the inlet of the pool skimmer assembly into the penetration, positioning an external adapter plate on an external surface of the pool wall about the penetration in the pool wall, the external adapter plate having an internal cavity sized to receive the inlet of the pool skimmer assembly and having a plurality of through holes positioned to receive the plurality of mechanical fasteners, and engaging the through holes of the external adapter plate with the through holes of the internal adapter plate with the plurality of mechanical fasteners.

In another aspect, the method may further include, prior to inserting the inlet of the pool skimmer assembly into the penetration, engaging the inlet of the pool skimmer assembly with an external adapter plate, the external adapter plate having an internal cavity sized to receive the inlet of the pool skimmer assembly and having a plurality of through holes positioned to receive the plurality of mechanical fasteners, and engaging the through holes of the external adapter plate with the through holes of the internal adapter plate with the plurality of mechanical fasteners.

In another aspect, the method may further include inserting an insert into the perforation in the wall of the pool. The insert may be made from polystyrene foam.

A further embodiment of the invention is a pool skimmer installation kit including or comprising an external adapter plate adapted to mount on an external surface of a pool wall about a penetration in the pool wall, the external adapter plate having an internal cavity sized to receive an inlet of a pool skimmer assembly and having a plurality of through holes positioned to receive a plurality of mechanical fasteners; an internal adapter plate adapted to mount on an internal surface of a pool wall about the penetration in the pool wall, the internal adapter plate having an internal cavity positioned to at least partially align with an inlet opening of the inlet of the pool skimmer assembly and a plurality of through holes positioned to receive a plurality of mechanical fasteners; and a plurality of fasteners adapted to retain the external adapter plate and the internal adapter plate on a pool wall. In one aspect, the kit may include at least one sealing device, such as, a gasket, and installation instructions, for example, an installation manual.

A further embodiment of the invention is a pool skimmer installation adapter plate comprising an internal cavity positioned to at least partially align with an inlet opening of an inlet of a pool skimmer assembly and a plurality of through holes positioned to receive a plurality of mechanical fasteners. In one aspect, the plurality of through holes in the adapter plate may be a plurality of elongated through holes. For example, the elongated through holes may have a major axis at least 20% greater than a minor axis. In another aspect, the internal cavity of the plate may be an open internal cavity. The adapter plate may be fabricated from a plastic or a metal, such as, aluminum.

A still further embodiment of the invention is a pool skimmer installation insert comprising a main body having an internal cavity adapted to at least partially align with an inlet of a pool skimmer assembly and a peripheral surface adapted to be received by an internal surface of a penetration in a pool wall. In one aspect, internal cavity may be adapted to substantially align with the inlet of the pool skimmer assembly. In another aspect, the peripheral surface of the insert may include at least one recess or at least one projection adapted to be received by the internal surface of the penetration in the pool wall. In another aspect, the internal cavity of the insert may be an open or a closed internal cavity.

These and other aspects, features, and advantages of this invention will become apparent from the following detailed description of the various aspects of the invention taken in conjunction with the accompanying drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF THE INVENTION

Figure 1:
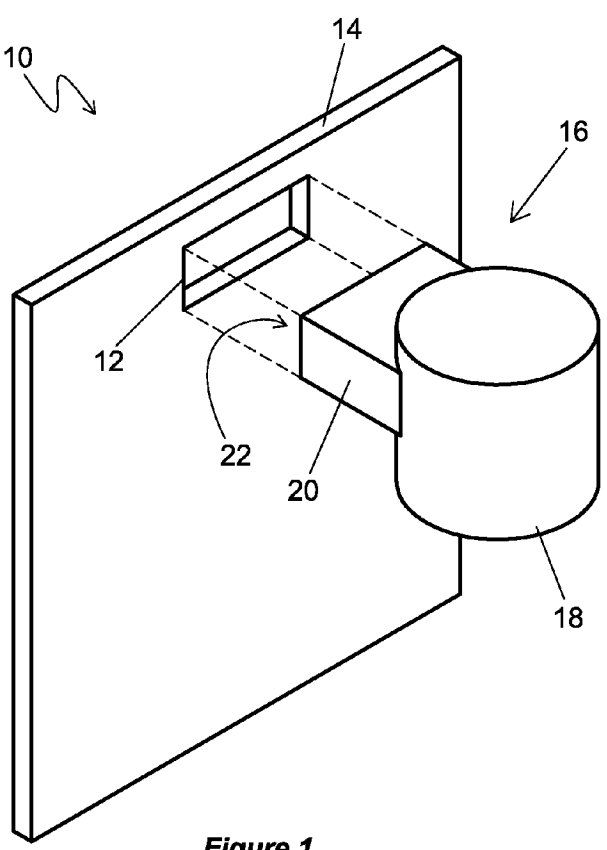
FIG. 1 is schematic perspective view of one skimmer assembly mounting to a perforation in a pool wall according to the prior art.

FIG. 1 is schematic perspective view of one skimmer assembly mounting 10 to a penetration or through hole 12 in a pool wall 14 according to the prior art. FIG. 1 illustrates a typical conventional pool skimmer assembly 16 having a body portion 18 sized to hold a skimmer basket (not shown) and an inlet passage 20 having an inlet opening 22 adapted to receive pool water. As shown in FIG. 1, as is typical of prior art skimmer assembly mountings, inlet opening 22 of skimmer assembly 16 is typically aligned with hole 12 and mounted to pool wall 14 with appropriate fasteners (not shown) whereby the inlet opening 22 in inlet passage 20 substantially aligns with the extents of hole 12. The substantial alignment of inlet passage 20 with the extents of hole 12 is represented by dashed lines in FIG. 1.

Figure 2:
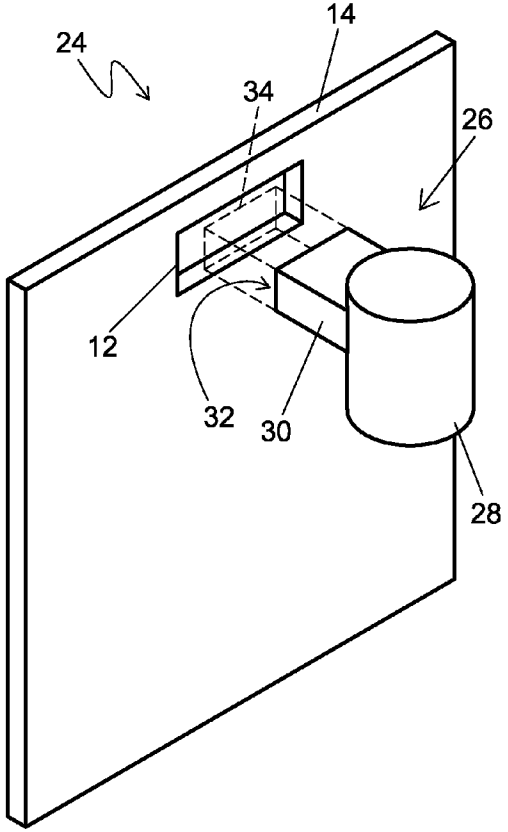
FIG. 2 is a schematic perspective view of another skimmer assembly mounting to the perforation in the pool panel shown in FIG. 1 according to the prior art.

FIG. 2 is a schematic perspective view of another skimmer assembly mounting 24 to the perforation 12 in a pool panel 14 shown in FIG. 1 according to the prior art. FIG. 2 illustrates another typical conventional pool skimmer assembly 26 having a body portion 28 sized to hold a skimmer basket (not shown) and an inlet passage 30 having an inlet opening 32 adapted to receive pool water. However, in contrast to the mounting arrangement to shown in FIG. 1, in the mounting arrangement 24 shown in FIG. 2, the inlet opening 32 of skimmer assembly 26 does not typically align with the extents of perforation 12. The substantial non-alignment of inlet passage 32 with the extents of perforation 12 is represented by dashed lines in FIG. 2. As shown, in this example employing one prior art skimmer assembly 26, the size of the inlet opening 32 of inlet passage 30 is much smaller than the size of perforation 12. This size difference is illustrated by the projection 34 of inlet opening 32 upon perforation 12.

As shown in FIG. 2, without proper modification of either hole 12 in wall 14 or inlet passage 30 in skimmer assembly 26, skimmer assembly 26 is incompatible with hole 12. However, in the art of swimming pool fabrication, the shape and dimensions of skimmer assemblies, such as, skimmer assembly 16 shown in FIG. 1 or skimmer assembly 26 shown in FIG. 2, though varied, may be limited. Specifically, providers of skimmer assemblies may provide a limited variation in the shape and dimensions of skimmer inlet passages 22, 32, and the pool installer must adapt the installation accordingly.

In addition, in the design of certain pool walls, or pool panels, the size of wall hole 12 is typically also limited, for example, by design or by the constraints of fabrication and shipping. For example, for panel-type pools, for example, those swimming pool panels designed and fabricated by Radiant Pools of Albany, N.Y., the unique insulated panel construction does not lend itself easily to modification of hole 12. For example, in some cases, multiple pool panels 14 may be provided having varying sizes for hole 12. Accordingly, the prior art skimmer mountings represented by the mountings shown in FIGS. 1 and 2 illustrate that there is a need in the art for an improved, more versatile skimmer mounting arrangement that overcomes the disadvantages illustrated by the examples shown in FIGS. 1 and 2. Aspects of the present invention provide one such solution.

Figure 4:
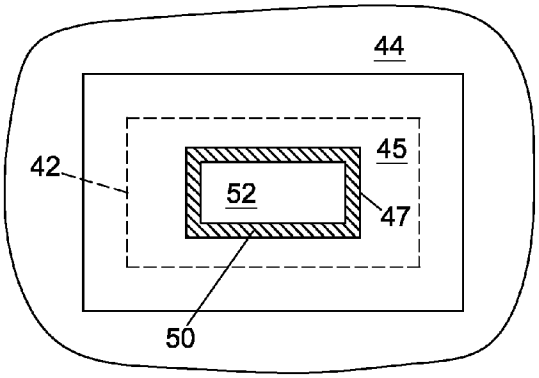
FIG. 4 is a detailed view, partially in cross section, of the skimmer assembly mounting arrangement shown in FIG. 3 as viewed along section lines 4-4 in FIG. 3.
Figure 3:
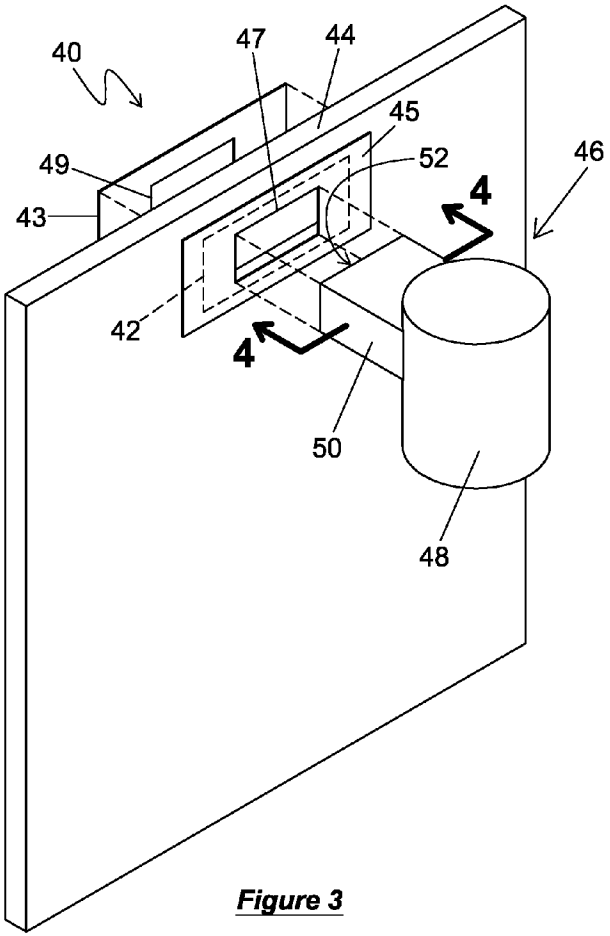
FIG. 3 is a schematic perspective view of a skimmer assembly mounting arrangement according to one aspect of the invention.

FIG. 3 is a schematic perspective view of a skimmer assembly mounting arrangement 40 according to one aspect of the invention. As shown in FIG. 3, arrangement 40 includes a skimmer assembly 46, for example, a skimmer assembly similar to skimmer assembly 26 shown in FIG. 2, having a body portion 48 sized to hold a skimmer basket (not shown) and an inlet passage 50 having an inlet opening 52 adapted to receive pool water. As also shown in FIG. 3, skimmer assembly 46 is adapted to be mounted to pool wall or panel 44 having through hole 42 (shown in phantom), for example, similar to hole 12 shown in FIGS. 1 and 2. FIG. 4 is a detailed view, partially in cross section, of the skimmer mounting 40 shown in FIG. 3 as viewed along section lines 4-4 in FIG. 3.

According to aspects of the present invention, FIGS. 3 and 4 illustrate an internal adapter plate 43 and an external adapter plate 45 for mounting skimmer assembly 46. Adapter plates 43 and 45 each typically comprises an internal cavity or through hole 47 and 49, respectively. Through holes, 47 and 49 are each adapted to at least partially align with inlet opening 52 of pool skimmer assembly 46. As shown in FIG. 4, in one aspect, internal cavity 47 in adapter plate 45 (and internal cavity 49 in plate 43) may be a closed cavity that is, having an uninterrupted internal surface; in another aspect (for example, see FIGS. 9 through 16), internal cavity 47 and/or 49 may be an open cavity. Though not shown in FIGS. 3 and 4, adapter plates 43 and 45 may typically include a plurality of through holes adapted to receive mechanical fasteners to secure plates 43 and/or 45 to panel 44 and/or to skimmer assembly 46.

According to aspects of the invention, by providing one or more adapter plates 43 and/or 45 that are sized to fit over hole 42 in pool wall or panel 44, pool wall or panel 44 may be provided with one or more holes 42 of a predetermined size and dimension and, with the use of an appropriately sized adapter plates 43 and/or 45, hole 42 may accommodate the use of two or more skimmer assemblies 46 having varyingly sized inlet passages 50. For example, in one aspect, hole 42 in wall or panel 44 may be sized to accommodate a first skimmer assembly 46 having a first inlet passage 50 of a first size and shape (for example, substantially identical to the size and shape of hole 42). Then, in order to accommodate one or more second skimmer assemblies 46 having a second inlet passage 50 having a second size and shape, one or more adapter plates or sets of adapter plates 43 and/or 45 may be provided. The one or more adapter plates or sets of plates 43 and/or 45 may have dimensions that at least partially cover hole 42 (but, preferably, dimensions that at least completely conceal hole 42) and have an internal perforation or through hole 47 and/or 49 sized and shaped to accommodate the size and shape of inlet passage 50 of the one or more second skimmer assemblies 46. Accordingly, in employing aspects of the invention, only one or a limited number of walls or panels 44 having one or more holes 42 of a predetermined size and shape may be provided while allowing the installation and use of two or more skimmer assemblies 46 having inlet passages 50 of varying size and shape. Specific examples of application of the invention are shown in FIGS. 5 through 8.

In FIGS. 3 and 4, adapter plates 43 and 45 are shown having a substantially rectangular shape, for example, reflective of the substantially rectangular shape of the inlet passage 50 of the skimmer 46. However, according to aspects of the invention, adapter plates 43 and/or 45 may assume a broad range of sizes shapes, and, depending upon the shape of the inlet passage 50, adapter plates 43 and 45 may have a broad range of shapes for through holes 47 and 49, respectively. For example, in one aspect, adapter plates 43 and 45 may be generally circular in shape, oval in shape, square in shape, or generally polygonal in shape, for example, hexagonal or octagonal in shape. In addition, through holes 47 and 49 may also be generally circular in shape, oval in shape, square in shape, or generally polygonal in shape, for example, hexagonal or octagonal in shape, for example, depending upon the size and shape of the inlet passage 50 of skimmer assembly 46.

In one aspect, the present invention may be uniquely adapted to pool panels or walls 44 having a thickness, for instance, a pool panel or wall 44 that is thicker than a conventional pool wall. For example, panel or wall 44 may include internal insulation, such as, panels provided by Radiant Pools. In one aspect, pool panel or wall 44 may comprise a thickness of at least about 0.125 inches, for example, at least about 1 inch. In one aspect, pool panel or wall 44 may have a thickness ranging from about 0.125 inch to about 6 inches, but is typically about 1 inch to about 3 inches in thickness, such as, about 2 inches in thickness.

In addition, though aspects of the invention may be uniquely adapted to panel-type pool walls, such as, wall or panel 44 in FIGS. 3 and 4, aspects of the invention may also be applied to pool walls comprising molded shapes, such as, shaped or poured concrete or other media, and to pools having liners, for example, vinyl liners.

Figure 6:
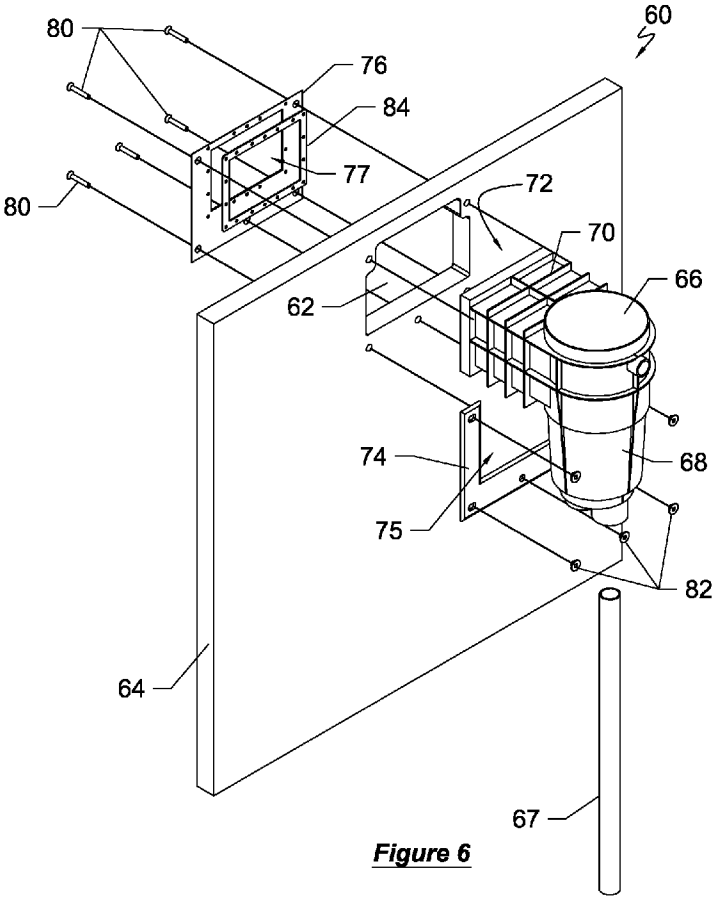
FIG. 6 is an exploded perspective view of the mounting arrangement shown in FIG. 5.
Figure 5:
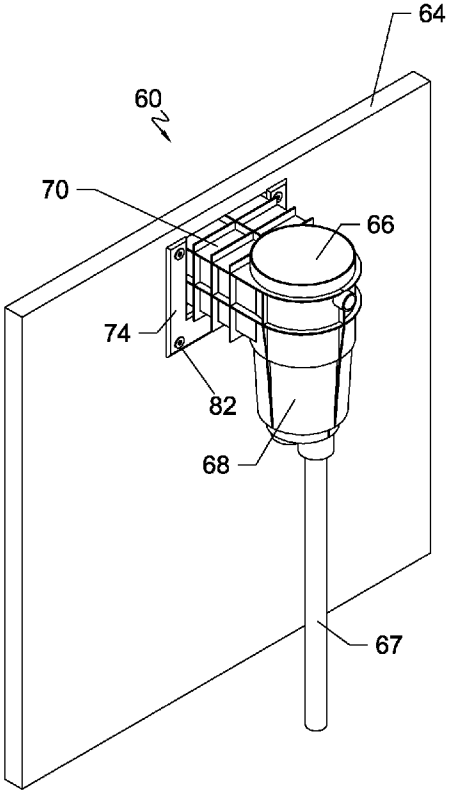
FIG. 5 is a perspective view of a mounting arrangement of one skimmer assembly to a perforation in a pool panel according to an aspect of the present invention.

FIG. 5 is a perspective view of a mounting arrangement 60 for one skimmer assembly 66 to a penetration or through hole 62 (not shown in FIG. 5) in a pool wall or panel 64 according to an aspect of the present invention. FIG. 6 is an exploded perspective view of the mounting arrangement 60 shown in FIG. 5. Penetration or through hole 62 in pool wall or panel 64 is clearly identified in FIG. 6.

As known in the art, skimmer assembly 66 shown in FIGS. 5 and 6 is typical of a skimmer assembly used for "in-ground" pool installations, for example, a Model SP1084 Series Auto-Skim™ Automatic Surface Skimmer by Hayward Pool Products of Elizabeth, N.J., or its equivalent. As is known in the art, "in-ground" installations are those where walls or panels 64 are installed beneath the surface of an adjacent deck, patio, or lawn and the like (for example, with the addition of backfill about the outside surface of the wall or panel 64), and only the top of skimmer assembly 66 is exposed to view and access. According to one aspect of the invention, skimmer assembly 66 may also not be an in-ground pool skimmer assembly, but may also be an above-ground pool assembly (for example, see below.) As shown in FIGS. 5 and 6, skimmer assembly 66 may be provided with a support pole or rod 67 to support skimmer assembly 66, though in some aspects, such as, in "above ground" pool installations (see below), no support rod 67 may be needed.

As shown in FIGS. 5 and 6, mounting arrangement 60 may include a skimmer assembly 66 having a body portion 68 sized to hold a skimmer basket (not shown) and an inlet passage 70 having an inlet opening 72 located and adapted to receive pool water. As also shown in FIG. 6, skimmer assembly 66 is adapted to be mounted to pool wall or panel 64 having a penetration or through hole 62, for example, similar to hole 12 shown in FIGS. 1 and 2 or to hole 42 shown in FIGS. 3 and 4. Though pool wall or panel 64 is shown generally planar in FIGS. 5 and 6, pool wall or panel 64 may also be curved, for example, concavely or convexly curved. According to aspects of the invention, hole 62 may be "pre-cut" in wall or panel 64; for example, in one aspect, hole 62 may be provided in wall or panel 64 as a panel or wall 64 is received from a supplier, for example, as received from Radiant Pools. In other aspects, hole 62 may be cut on site, for example, "in the field." In addition, though not shown in FIGS. 5 and 6, pool wall or panel 64 may also include a pool liner, for example, similar to pool liner 97 shown in FIGS. 7 and 8.

According to one aspect of the invention, mounting arrangement 60 includes one or more adapter plates, for example, one or more external or outside adapter plates 74 and/or one or more internal or inside adapter plates 76 adapted to mount skimmer assembly 66 to panel or wall 64. As shown in FIG. 6, external adapter plate 74 includes an internal cavity 75 and internal adapter plate 76 includes an internal cavity 77. External adapter plate 74, internal cavity 75, internal adapter plate 76, and internal cavity 77 may each be sized and shaped to accommodate the size and shape of skimmer assembly 66. For example, as shown in FIG. 6, external adapter plate 74 may be generally rectangular, but may also be circular, oval, square, or generally polygonal in shape. As shown in FIG. 6, in order to facilitate installation, internal cavity 75 of external adapter plate 74 may be an open cavity, for example, whereby external adapter plate 74 may be "u-shaped." The open internal cavity 75 may be adapted to engage, for example, slidingly engage, the outside surface of inlet passage 70, for instance, slidingly engage one or more corresponding slots, ribs, or passages on or in inlet passage 70 of skimmer assembly 66. As also shown in FIG. 6, internal adapter plate 76 may be substantially rectangular in shape to accommodate the shape of inlet passage 70, but may also be circular, oval, square, or generally polygonal in shape. Internal cavities 75 and 77 may also be substantially rectangular in shape to accommodate the shape of inlet passage 100, but may also be circular, oval, square, or generally polygonal in shape. Internal cavities 75 and 77 may be opened or closed cavities.

External adapter plate 74 and internal adapter plate 76 may be adapted to be mounted to panel or wall 64 by conventional means, for example, via a plurality of mechanical fasteners, such as, bolts 80 and nuts 82, for example, t-nuts. Bolts 80 may engage through holes in external adapter plate 74, through holes in panel 64, and/or though holes in internal adapter plate 76 in securing skimmer assembly 66 to panel or wall 64.

External adapter plate 74 and internal adapter plate 76 may be fabricated from any convenient material, including a metal, a plastic, a rubber, and even a wood. In one aspect of the invention, external adapter plate 74 and internal adapter plate 76 may preferably be fabricated from a plastic, for example, a polyamide (PA), for instance, nylon; a polyethylene (PE), both high-density polyethylene (HDPE) and low-density polyethylene (LDPE); a polyethylene terephthalate (PET); a polypropylene (PP); a polyester (PE); a polytetrafluoroethylene (PTFE); a polystyrene (PS); an acrylonitrile butadiene styrene (ABS); a polycarbonate (PC); or a polyvinylchloride (PVC); among other plastics. External adapter plate 74 and internal adapter plate 76 may also be fabricated from a metal, for example, aluminum, steel, or stainless steel, among other structural metals.

Mounting arrangement 60 may also include one or more sealing devices 84, for example, gaskets, seals, or other sealing devices 84 in order to minimize or prevent leakage of pool water. For example, a sealing device 84 may be positioned between internal mounting plate 76 and the surface of the face of inlet passage 70. In another aspect, though not shown in FIG. 6, a sealing device 84 may be positioned on the internal surface of internal mounting plate 76 and a pool liner (not shown). A faceplate (not shown) may also be mounted to internal mounting plate 76 to, among other things, capture the pool liner (not shown). Though a broad range of conventional types of gaskets or seals may used for sealing device 84, in one aspect, sealing device 84 may be a gasket, for example, a Model SP1084 gasket provided by Hayward Pool Products, or its equivalent.

According to one aspect of the invention, it is envisioned that the mounting arrangement 60 shown in FIGS. 5 and 6 may be installed by the following procedures. First, positioning a sealing device 84, for example, a gasket, on either side of the internal adapter plate 76. Positioning the internal adapter plate 76 with sealing devices 84 against the internal surface of panel 64 and inserting inlet passage 70 of skimmer assembly 66 into panel hole 62 so that the face of the inlet passage contacts the sealing device 84. Then securing the internal adapter plate 76 with sealing devices 84 to the face of the inlet passage 70 with mechanical fasteners, for example, with pan-head screws, to at least partially retain the skimmer assembly 76 in hole 62.

With the skimmer assembly 76 somewhat retained in hole 62, engaging, for example, sliding, the external adapter plate 74 onto inlet passage 70 and aligning the through holes in panel 64 with the through holes in external adapter plate 74. External adapter plate 74 is then secured to panel 64 and internal adapter plate 76 by inserting screws 80 through holes in internal adapter plate 76, panel 64, and external adapter plate 74 and applying nuts 82 to screws 80. Accordingly, upon tightening of nuts 82, skimmer assembly 66, external adapter plate 74, and internal adapter plate 76 are secured to panel 64. In one aspect, after mounting skimmer assembly 66 as described above, support rod 67 may be positioned and secured to skimmer assembly 66, as needed. Though not shown in FIGS. 5 and 6, when a pool liner is provided, the liner—with an appropriately sized and positioned skimmer through hole—may be mounted inside of the panel 64 and a skimmer faceplate (not shown) may be mounted to the internal adapter plate 76 to, among other things, secure the liner to skimmer assembly 66. Modifications or alterations to the above procedure or its sequence of implementation are also envisioned without detracting from the present invention.

As shown in FIGS. 5 and 6, according to aspects of the present invention, a mounting arrangement is if is adapted to mount one, or a first, skimmer assembly 66 to a penetration or through hole 62 in a pool wall or panel 64. However, as will be shown by the example illustrated in FIGS. 7 and 8, substantially the same panel or wall 64 having the substantially the same perforation or through hole 62 may also be adapted to receive another, or a second, skimmer assembly having a different geometry.

Figure 8:
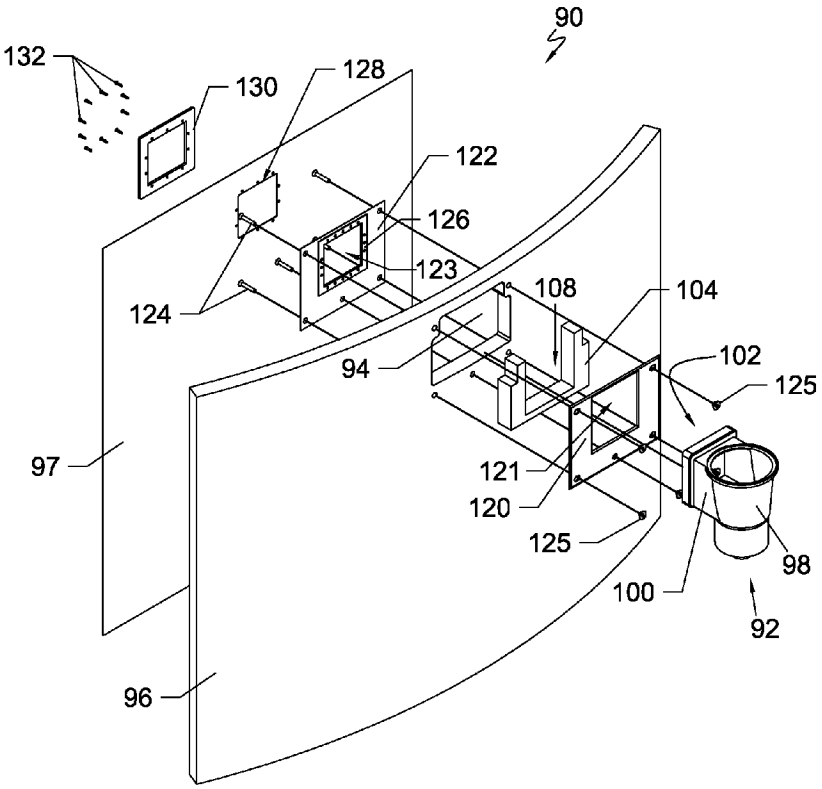
FIG. 8 is an exploded perspective view of the mounting arrangement shown in FIG. 7.
Figure 7:
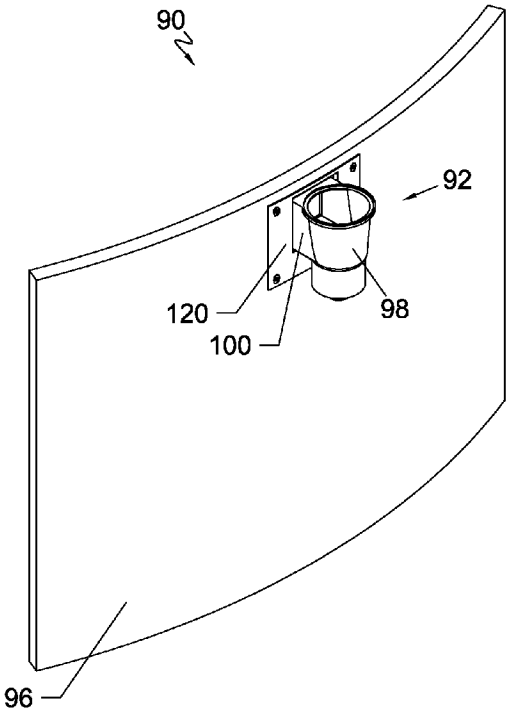
FIG. 7 is a perspective view of a mounting arrangement of another skimmer assembly to a perforation in a pool panel shown according to an aspect of the present invention.

FIG. 7 is a perspective view of a mounting arrangement 90 for another skimmer assembly 92 to be mounted to a perforation 94 (not shown in FIG. 7) in a pool panel 96 according to an aspect of the present invention. FIG. 8 is an exploded perspective view of the mounting arrangement 90 shown in FIG. 7. Though pool wall or panel 96 is shown generally curved in FIGS. 7 and 8, specifically, convexly curved, pool wall or panel 96 may also be concavely curved or planar, for example, as shown in FIGS. 5 and 6.

As known in the art, skimmer assembly 92 shown in FIGS. 7 and 8 is typical of a skimmer assembly used for "above ground" or "partially above ground" pool installations. For example, skimmer assembly 92 may be a Model SP1091 Series Dyna-Skim™ Automatic Skimmer by Hayward Pool Products, or its equivalent. As is known in the art, "above ground" or "partially above ground" installations are those where walls or panels 96 are installed where the outer surface of walls or panels are not located beneath the surface of an adjacent deck, patio, or lawn and the like (for example, there is no backfill about the outside surface of the wall or panel 96), and, among other things, the panel or wall 96 may not rely on the support of any adjacent material. In one aspect, in an above ground installation, mounting arrangement 90 and skimmer assembly 92 may be exposed for access and maintenance as needed. According to aspects of the invention, skimmer assembly 92 may also not be an above ground pool skimmer assembly, but may also be an in-ground pool assembly. In contrast to the skimmer assembly 66 shown in FIGS. 5 and 6, skimmer assembly 92 may not require a support pole or rod (67 in FIGS. 5 and 6), though in some aspects, a support rod, similar to support rod 67 in FIGS. 5 and 6, may be used for skimmer assembly 92 shown in FIGS. 7 and 8.

As also shown in FIGS. 7 and 8, in one aspect, the panel wall or panel 96 adapted to be used with aspects of the invention may be provided with a pool liner 97, though liner 97 may be omitted in some aspects. As known in the art, pool liner 97 (only a portion of which is shown in FIG. 8) may be any liquid impermeable membrane or barrier, for example, a vinyl plastic barrier, adapted to retain pool water. As also known in the art, when a pool liner 97 is present, pool liner 97 and the water it retains are typically supported by pool panel or wall 96, and, as will be discussed below, pool liner 97 may interface with the mounting arrangement 90, as needed.

As shown in FIGS. 7 and 8, mounting arrangement 90 is typically adapted to install skimmer assembly 92 having a body portion 98 sized to hold a skimmer basket (not shown) and an inlet passage 100 having an inlet opening 102 located and adapted to receive pool water. As also shown in FIG. 8, skimmer assembly 92 is adapted to be mounted to pool wall or panel 96 having a penetration or through hole 94, for example, a hole similar to hole 12 shown in FIGS. 1 and 2, or hole 42 shown in FIGS. 3 and 4, or hole 62 shown in FIGS. 5 and 6. Again, as discussed with respect to hole 62 shown in FIGS. 5 and 6, according to aspects of the invention, hole 94 may be "pre-cut" in wall or panel 96; for example, in one aspect, hole 94 may be provided in wall or panel 96 as panel or wall 96 is received from a supplier, for example, as received from Radiant Pools. In other aspects, perforation 94 may be cut on site, for example, "in the field."

According to aspects of the invention, as shown in FIGS. 7 and 8, in a fashion similar to mounting arrangement 60 shown in FIGS. 5 and 6, mounting arrangement 90 includes an external or outside adapter plate 120 having an internal cavity 121 and an internal or inside adapter plate 122 having an internal cavity 123, each plate 120, 122 is adapted to mount skimmer assembly 92 to panel or wall 96. External adapter plate 120, internal cavity 121, internal adapter plate 122, and internal cavity 123 may each be sized and shaped to accommodate the size and shape of skimmer assembly 92. For example, as shown in FIG. 8 external adapter plate 120 may be generally rectangular in shape, but may also be circular, oval, square, or generally polygonal in shape.

External adapter plate 120 may be adapted to engage, for example, slidingly engage, the outside surface of inlet passage 100, for instance, slidingly engage one or more corresponding slots, ribs, or passages on or in the outside surface of inlet passage 100 of skimmer assembly 92. As also shown in FIG. 8, internal adapter plate 122 may also be substantially rectangular in shape to accommodate the shape of inlet passage 100, but may also be circular, oval, square, or generally polygonal in shape. Internal cavities 121, 123 may also be substantially rectangular in shape to accommodate the shape of inlet passage 100, but may also be circular, oval, square, or generally polygonal in shape. Internal cavities 121 and 123 may be opened or closed cavities.

External adapter plate 120 and internal mounting plate 122 may be adapted to be mounted to panel or wall 96 by conventional means, for example, via a plurality of mechanical fasteners, such as, bolts 124 and nuts 125, for example, t-nuts. Bolts 124 may engage through holes in external adapter plate 120, through holes in panel 96, and/or though holes in internal adapter plate 122 in securing skimmer assembly 92 to panel 96.

External adapter plate 120 and internal adapter plate 122 may be fabricated from any convenient material, including a metal, a plastic, a rubber, and even a wood. In one aspect of the invention, external adapter plate 120 and internal adapter plate 122 may preferably be fabricated from a plastic, for example, a polyamide (PA), for instance, nylon; a polyethylene (PE), both high-density polyethylene (HDPE) and low-density polyethylene (LDPE); a polyethylene terephthalate (PET); a polypropylene (PP); a polyester (PE); a polytetrafluoroethylene (PTFE); a polystyrene (PS); an acrylonitrile butadiene styrene (ABS); a polycarbonate (PC); or a polyvinylchloride (PVC); among other plastics. External adapter plate 120 and internal adapter plate 122 may also be fabricated from a metal, for example, aluminum, steel, or stainless steel, among other structural metals.

Mounting arrangement 90 may also include one or more sealing devices 126, such as, gaskets, seals, or other sealing devices 126 in order to minimize or prevent leakage of pool water. For example, a sealing device 126 may be positioned between internal adapter plate 122 and the internal surface of panel 96 and/or between external adapter plate 120 and the external surface of wall or panel 96. Though a broad range of conventional types of gaskets or seals may used for sealing device 126, in one aspect, sealing device 126 may be a "butterfly"-type gasket, for example, a Model SPX1091G butterfly-type gasket provided by Hayward Pool Products, or its equivalent.

As also, shown in FIG. 8, according to one aspect of the invention, mounting arrangement 90 shown in FIGS. 7 and 8 may include one or more wall or panel inserts or, simply, "inserts," 104. As shown in FIG. 8, insert 104 may comprise a generally rectangular body and be adapted to fit within the hole 94 in panel 96. For example, insert 104 may be adapted to fill one or more voids in panel 96 that may be present when a skimmer assembly 92 having an inlet passage 100 that is smaller than hole 94 is panel 96 is used. Insert 104 typically includes an internal cavity or through hole 108 adapted to at least partially align with inlet opening 102 of pool skimmer assembly 92, preferably substantially align, and a peripheral surface, perimeter surface, or outside surface adapted to be received by the internal surface of hole 94 in pool wall panel 96. In one aspect of the invention, insert 104 may be omitted. However, in another aspect, insert 104 may be provided to at least partially occupy the void created between the outside of inlet passage 100 and the internal surfaces of hole 94. In other aspects, this void may be filled with any appropriate material, for example, spray foam insulation.

Insert 104 may be fabricated from any appropriate material while still providing the function disclosed herein. For example, insert 104 may be fabricated from a metal, a plastic, a rubber, or even wood. However, in one aspect of the invention, adapter plate 104 may preferably be fabricated from a plastic foam material, for example, a polystyrene foam, for instance, a polystyrene foam having a density of 1.5 pounds per cubic foot [pcf].

As also shown in FIG. 8, when a liner 97 is present, the liner 97 may typically include a perforation or through hole 128 and through which skimmer inlet too may be accessed by pool water. Accordingly, in one aspect, mounting arrangement 90 may also include a face plate 130 adapted to mount to or about hole 128 in liner 97 to, among other things, retain and protect the liner 97, for example, retain the liner 97 to internal mounting plate 122. Face plate 130 may be adapted to be mounted to panel or wall 96 or to mounting arrangement 90 by conventional means, for example, via a plurality of mechanical fasteners, such as, bolts or screws 132, or the like.

According to one aspect of the invention, it is envisioned that the mounting arrangement 90 shown in FIGS. 7 and 8 may be installed by the following procedures. First, positioning insert 104 into hole 94. Then mounting sealing device 126, for example, a "butterfly"-type gasket onto internal adapter plate 122, for example, about cavity 123. Positioning the internal adapter plate 122 with sealing device 126 against the internal surface of panel 96 about hole 94, positioning external adapter plate 120 against the external surface of panel 96 about hole 94, and inserting bolts 124 through the holes in internal adapter plate 122, panel 96, and external adapter plate 120. Attaching nuts 125 to bolts 124 whereby, upon tightening of nuts 125 and bolts 124, internal adapter plate 122 and external adapter plate 120 are secured to panel 120 and encapture insert 104 between them in hole 94. With the mounting of external adapter plate 120, internal adapter plate 122, and insert 104 to panel 96, the alignment of the respective cavities in the adapter plate 122, external adapter plate 120, and insert 104 define a passage or cavity for inlet passage 100 of skimmer assembly 92.

Next, the installer inserts the inlet passage 100 of skimmer assembly 92 into the passage defined by the respective cavities in adapter plate 122, external adapter plate 120, and insert 104. Then securing the skimmer assembly 92 to internal adapter plate 122 with mechanical fasteners, for example, with pan-head screws, to retain the skimmer assembly 92 in hole 94. As shown in FIGS. 7 and 8, when provided, the pool liner 97—with an appropriately sized and positioned skimmer through hole 128—may be mounted inside of the panel 96 and a skimmer faceplate 130 may be mounted to the internal adapter plate 122 to, among other things, secure the liner 97 to skimmer assembly 92. Modifications or alterations to the above procedure or its sequence of implementation are also envisioned without detracting from the present invention.

Figures 9, 10:
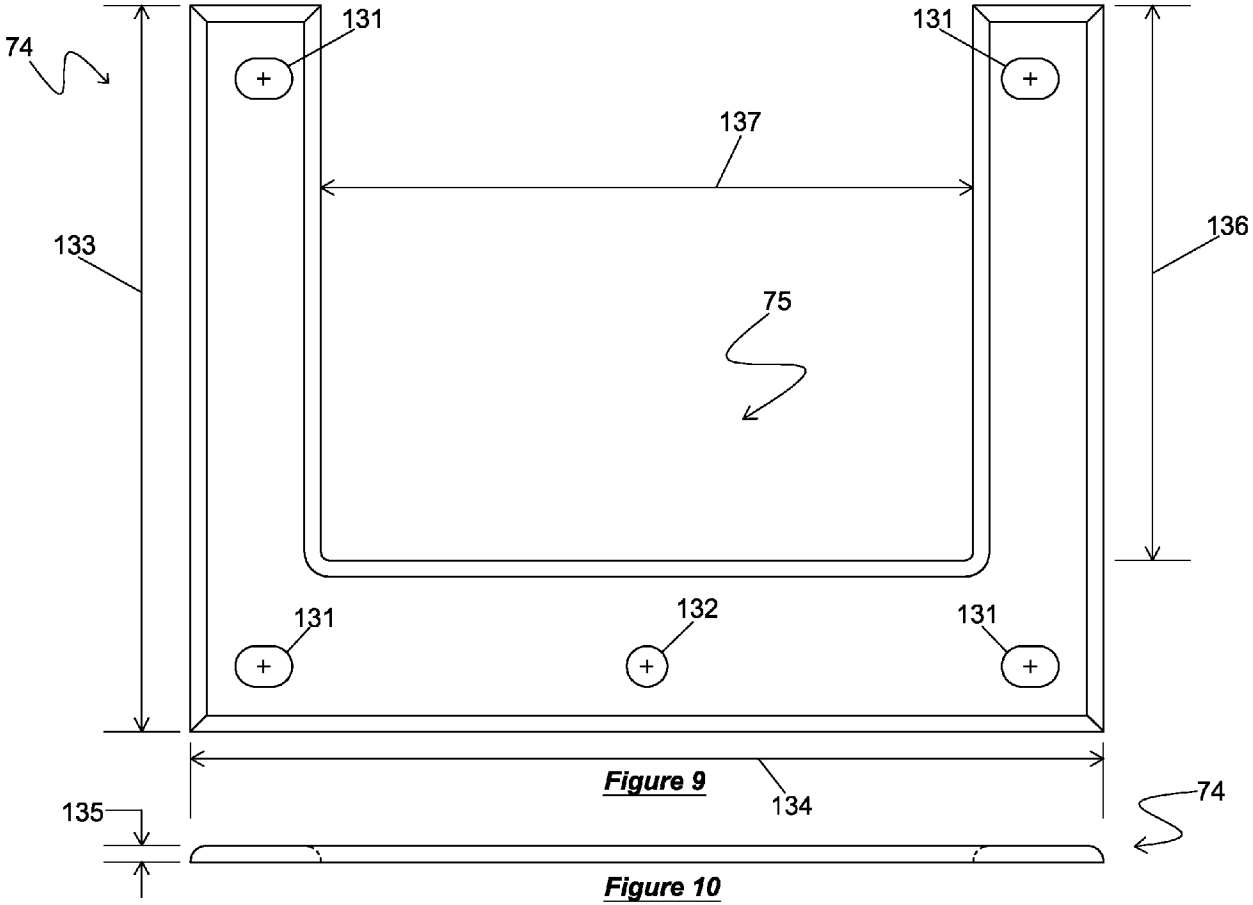
FIG. 9 is a front plan view of one external adapter plate according to one aspect of the invention.
FIG. 10 is a bottom elevation view of the external adapter plate shown in FIG. 9.

FIG. 9 is a front plan view of the external adapter plate 74 having internal cavity 75 shown in FIGS. 5 and 6 according to one aspect of the invention. FIGURE to is a bottom elevation view of external adapter plate 74 shown in FIG. 9. (Reference Applicant drawings 3284 OUT "white") As shown in FIG. 9, in one aspect, external adapter plate 74 may be generally rectangular and have an open, generally rectangular, internal cavity 75. Plate 74 may have a plurality of though holes 131, 132, for example, through holes 131 adapted and positioned to receive mounting bolts 80. Adapter plate 74 may also be beveled or radiused along any or all exposed edges, for example, to enhance appearance and facilitate handling.

As shown in FIG. 9, in one aspect, through holes 131 may be elongated, oval, or race-track-oval-shaped through holes. In this aspect, elongated through holes 131 may be provide to allow for some misalignment of holes in mating sealing device 84 or panel 64. For example, in one aspect, elongated through holes 131 may accommodate dimensional tolerance buildup or the variation in are length or chord length between an internal surface of curved panel 64 and an external surface of curved panel 64. In one aspect, the elongated through holes may have a major axis dimension at least 20% greater than their minor axis dimension, preferably at least 40% greater. For example, the elongated through holes may have a width (that is, major axis dimension) of 0.875 inches and a height (that is, minor axis dimension) of 0.625 inches, which corresponds to an increase in dimension of 40%.

As shown in FIGS. 9 and 10, external adapter plate 74 may have a height 133, a width 134, and a thickness 135, and internal cavity 75 may have a height 136 and a width 137. According to aspects of the invention, external adapter plate 74 may have a height 133 ranging from about 3 inches to about 36 inches, but typically has a height 133 ranging from about 6 inches to about 18 inches, for example, about 11⅛ inches. External adapter plate 74 may have a width 134 ranging from about 3 inches to about 36 inches, but typically has a width 134 ranging from about 6 inches to about 18 inches, for example, about 14 inches. External adapter plate 74 may have a thickness 135 ranging from about 1/16 inch to about 1 inch, but typically has a thickness 135 ranging from about 1/8 inch to about 1/2 inch, for example, about 4 inch. Internal cavity 75 of external adapter plate 74 may have a height 136 ranging from about 3 inches to about 24 inches, but typically has a height 136 ranging from about 4 inches to about 12 inches, for example, about 8 1/2 inches. Internal cavity 75 may have a width 137 ranging from about 3 inches to about 24 inches, but typically has a width 137 ranging from about 8 inches to about 14 inches, for example, about to inches.

Figures 11, 12:
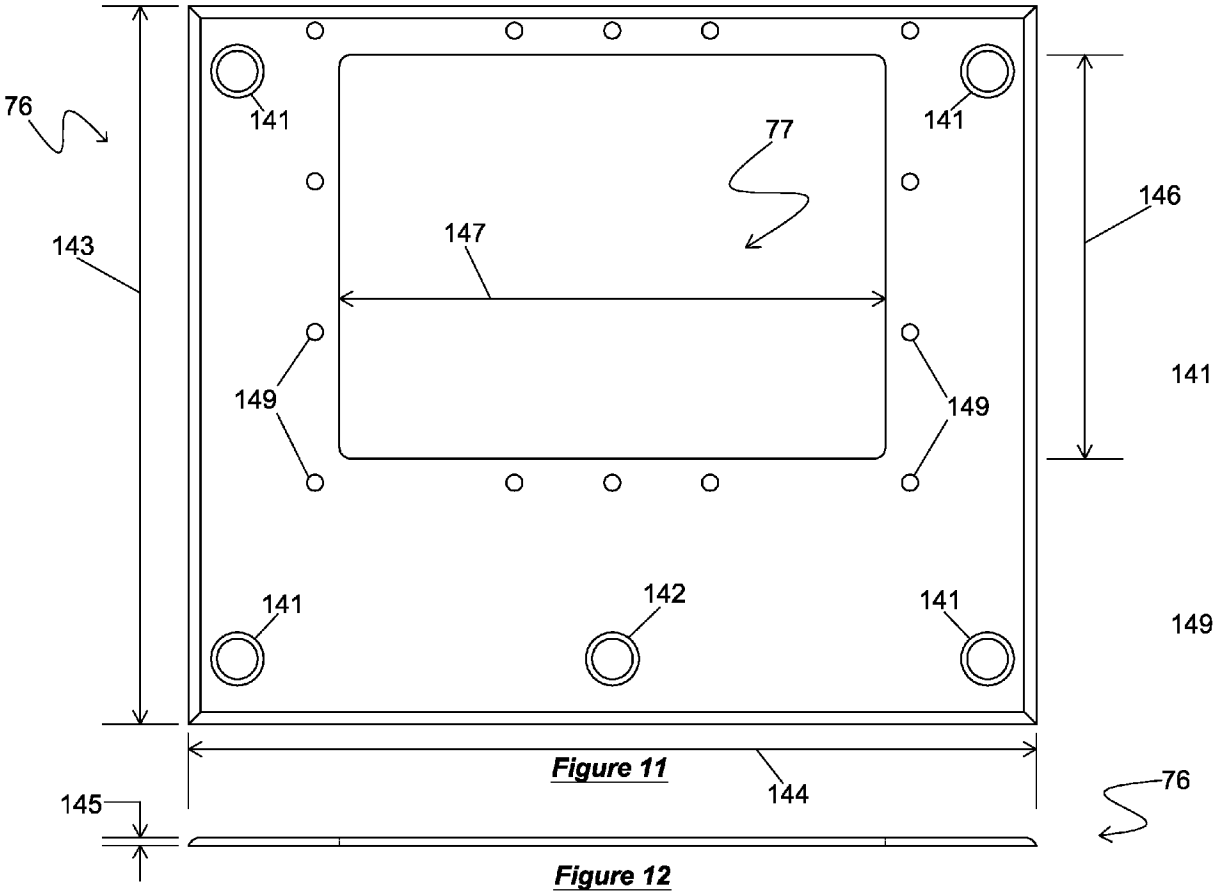
FIG. 11 is a front plan view of one internal adapter plate according to one aspect of the invention.
FIG. 12 is a bottom elevation view of the internal adapter plate shown in FIG. 11.

FIG. 11 is a front plan view of internal adapter plate 76 having internal cavity 77 shown in FIGS. 5 and 6 according to one aspect of the invention. FIG. 12 is a bottom elevation view of internal adapter plate 76 shown in FIG. 11. As shown in FIG. 11, in one aspect, internal adapter plate 76 may be generally rectangular in shape and have a closed, generally rectangular, internal cavity 7. Plate 76 may have a plurality of though holes 141, 142, and 149 for example, counter-sunk through holes 141 adapted and positioned to receive mounting bolts 80. Adapter plate 76 may also be beveled or radiused along any or all exposed edges, for example, to enhance appearance and facilitate handling.

As shown in FIGS. 11 and 12, internal adapter plate 76 may have a height 143, a width 144, and a thickness 145, and internal cavity 77 may have a height 146 and a width 147. According to aspects of the invention, internal adapter plate 76 may have a height 143 ranging from about 3 inches to about 36 inches, but typically has a height 143 ranging from about 6 inches to about 18 inches, for example, about 11 inches. Internal adapter plate 76 may have a width 144 ranging from about 3 inches to about 36 inches, but typically has a width 144 ranging from about 6 inches to about 18 inches, for example, about 13 inches. Internal adapter plate 77 may have a thickness 145 ranging from about 1/16 inch to about 1/2 inch, but typically has a thickness 145 ranging from about 1/8 inch to about 1/4 inch, for example, about 1/8 inch. Internal cavity 77 of internal adapter plate 76 may have a height 146 ranging from about 3 inches to about 24 inches, but typically has a height 146 ranging from about 4 inches to about 12 inches, for example, about 6 3/16 inches. Internal cavity 77 may have a width 147 ranging from about 3 inches to about 24 inches, but typically has a width 147 ranging from about 4 inches to about 12 inches, for example, about 8 3/8 inches.

Figures 13, 14:
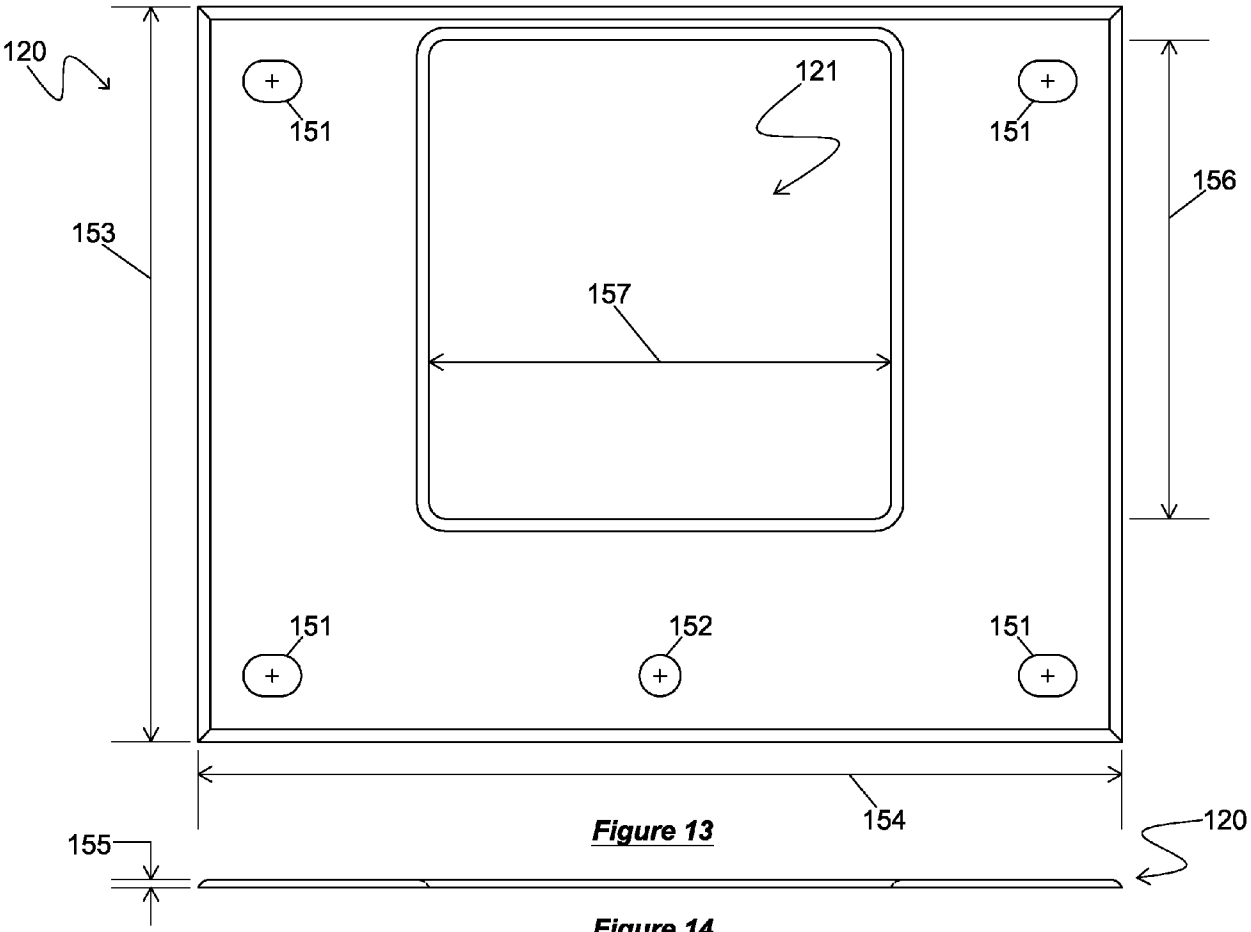
FIG. 13 is a front plan view of another external adapter plate according to one aspect of the invention.
FIG. 14 is a bottom elevation view of the external adapter plate shown in FIG. 13.

FIG. 13 is a front plan view of external adapter plate 120 having internal cavity 121 shown in FIGS. 7 and 8 according to one aspect of the invention. FIG. 14 is a bottom elevation view of external adapter plate 120 shown in FIG. 13. (Reference Applicant drawings 3291 OUT "white") As shown in FIG. 13, in one aspect, external adapter plate 120 may be generally rectangular and have a closed, generally rectangular, internal cavity 121. Plate 120 may have a plurality of though holes 151, 152, for example, through holes 151 adapted and positioned to receive mounting bolts 124. Adapter plate 120 may also be beveled or radiused along any or all exposed edges, for example, to enhance appearance and facilitate handling.

As shown in FIG. 13, in one aspect, through holes 151 may be elongated, or race-track-oval-shaped, through holes. In this aspect, elongated through holes 151 may be provide to allow for some misalignment of holes in mating panel 96. For example, in one aspect, elongated through holes 151 may accommodate dimensional tolerance buildup or the variation in arc length or chord length between an internal surface of curved panel 96 and an external surface of curved panel 96.

As shown in FIGS. 13 and 14, external adapter plate 120 may have a height 153, a width 154, and a thickness 155, and internal cavity 121 may have a height 156 and a width 157. According to aspects of the invention, external adapter plate 120 may have a height 153 ranging from about 3 inches to about 36 inches, but typically has a height 153 ranging from about 6 inches to about 18 inches, for example, about 11 1/8 inches. External adapter plate 120 may have a width 154 ranging from about 3 inches to about 36 inches, but typically has a width 154 ranging from about 6 inches to about 18 inches, for example, about 14 inches. External adapter plate 120 may have a thickness 155 ranging from about 1/16 inch to about 1/2 inch, but typically has a thickness 155 ranging from about 1/16 inch to about 1/4 inch, for example, about 1/8 inch. Internal cavity 121 of external adapter plate 120 may have a height 156 ranging from about 3 inches to about 24 inches, but typically has a height 156 ranging from about 4 inches to about 12 inches, for example, about 7 1/4 inches. Internal cavity 121 may have a width 157 ranging from about 3 inches to about 24 inches, but typically has a width 157 ranging from about 3 inches to about 12 inches, for example, about 7 inches.

Figures 15, 16:
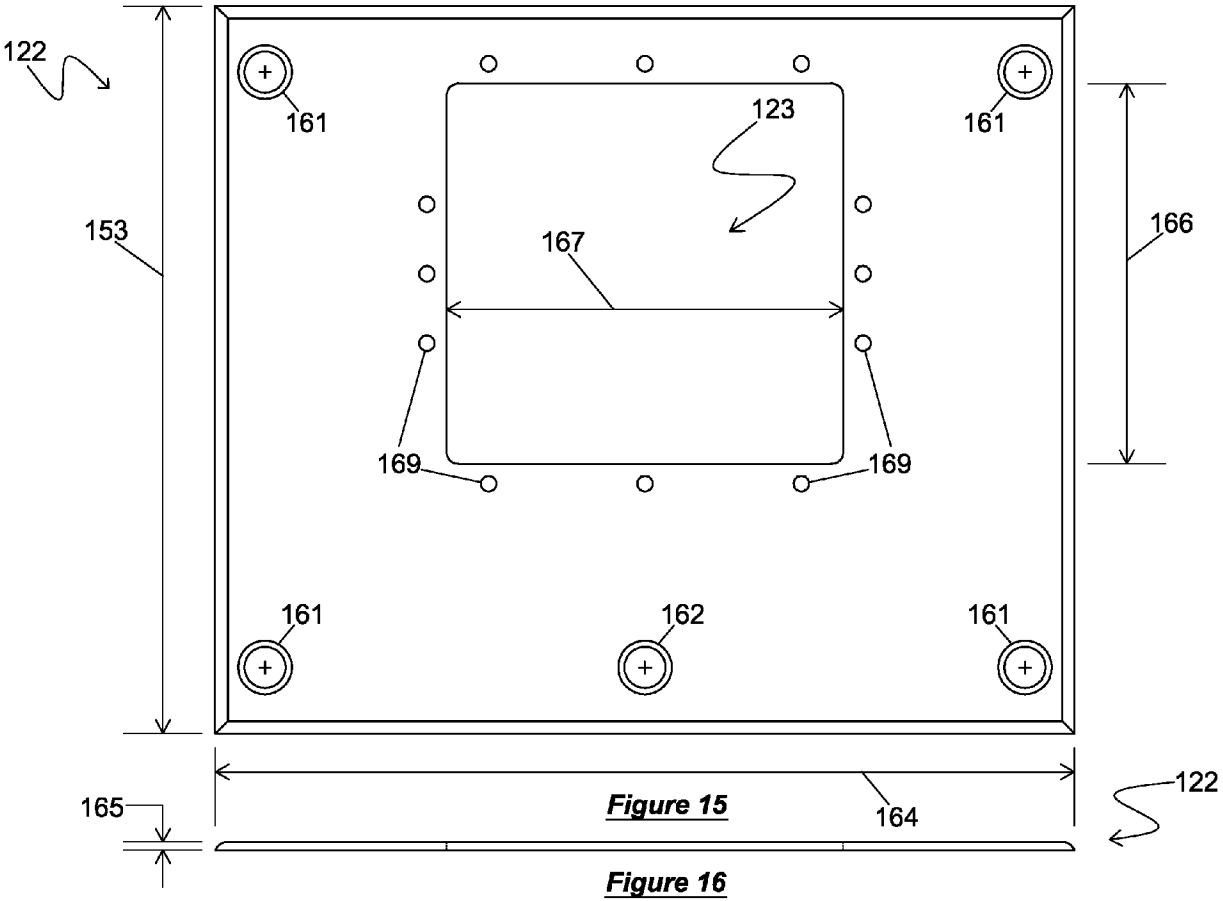
FIG. 15 is a front plan view of another internal adapter plate according to one aspect of the invention.
FIG. 16 is a bottom elevation view of the internal adapter plate shown in FIG. 15.

FIG. 15 is a front plan view of internal adapter plate 122 having internal cavity 123 shown in FIGS. 7 and 8 according to one aspect of the invention. FIG. 16 is a bottom elevation view of internal adapter plate 122 shown in FIG. 15. (Reference Applicant drawings 3291 IN "gray") As shown in FIG. 15, in one aspect, internal adapter 122 may be generally rectangular in shape and have a closed, generally rectangular, internal cavity 123. Plate 122 may have a plurality of though holes 161, 162, and 169, for example, counter-sunk through holes 161 adapted and positioned to receive mounting bolts 124. Adapter plate 122 may also be beveled or radiused along any or all exposed edges, for example, to enhance appearance and facilitate handling.

As shown in FIGS. 15 and 16, internal adapter plate 122 may have a height 163, a width 164, and a thickness 165, and internal cavity 123 may have a height 166 and a width 167. According to aspects of the invention, internal adapter plate 122 may have a height 163 ranging from about 3 inches to about 36 inches, but typically has a height 163 ranging from about 6 inches to about 18 inches, for example, about 11 inches. Internal adapter plate 122 may have a width 164 ranging from about 3 inches to about 36 inches, but typically has a width 164 ranging from about 6 inches to about 18 inches, for example, about 13 inches. Internal adapter plate 122 may have a thickness 165 ranging from about 1/16 inch to about 1/2 inch, but typically has a thickness 165 ranging from about 1/8 inch to about 1/4 inch, for example, about 1/8 inch. Internal cavity 123 of internal adapter plate 122 may have a height 166 ranging from about 3 inches to about 24 inches, but typically has a height 166 ranging from about 4 inches to about 12 inches, for example, about 6 3/4 inches. Internal cavity 123 may have a width 167 ranging from about 3 inches to about 24 inches, but typically has a width 167 ranging from about 4 inches to about 12 inches, for example, about 6 inches.

Figures 17, 18:
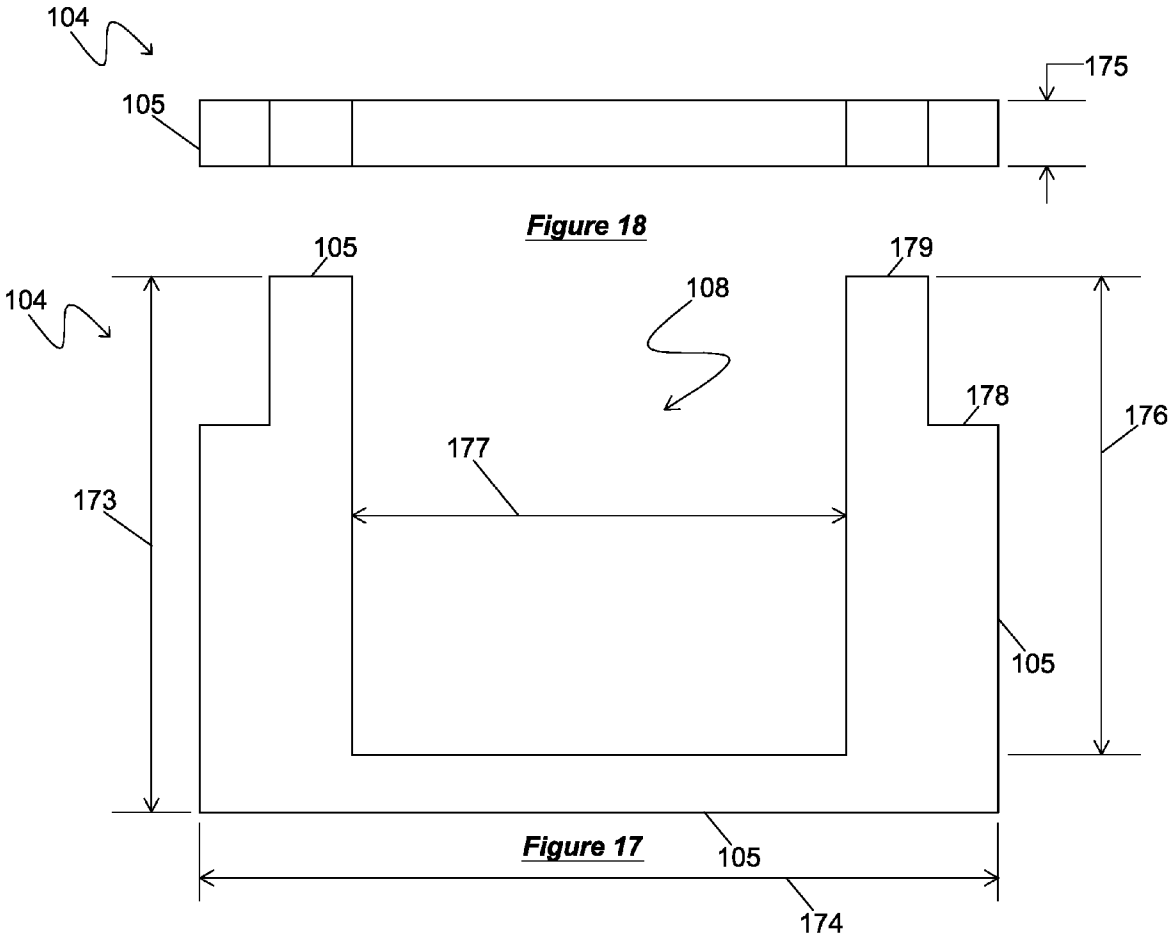
FIG. 17 is a front election view of the insert shown in FIGS. 7 and 8 according to one aspect of the invention.
FIG. 18 is a top plan view of the insert shown in FIG. 17.

FIG. 17 is a front election view of insert 104 having internal cavity 108 shown in FIGS. 7 and 8 according to one aspect of the invention.

FIG. 18 is a top plan view of insert 104 shown in FIG. 17. (Reference Applicant drawings 3291 F.) As shown in FIG. 17, in one aspect, insert 104 may be generally rectangular in shape and have a peripheral surface or perimeter 105 adapted to be inserted and/or received into hole 94 in panel 96 (See FIG. 8.), and have an open, generally rectangular, internal cavity 108, though internal cavity 108 may also be closed internal cavity. In another aspect, insert 104 may comprise one or more individual bodies or pieces.

In FIGS. 17 and 18 insert 104 is shown having a generally rectangular shape, that is, reflecting the generally rectangular shape of the inlet passage 100 of skimmer assembly 92. However, according to aspects of the invention, insert 104 may assume a broad range of shapes, and, depending upon the shape of the inlet passage 100 of skimmer assembly 92 with which insert 104 is used, may have a broad range of shapes of internal cavity 108. For example, in one aspect, insert 104 may be generally circular in shape, oval in shape, square in shape, or generally polygonal, for example, hexagonal or octagonal in shape. In addition, internal cavity 108 may also be may be generally circular in shape, oval in shape, square in shape, or generally polygonal, for example, hexagonal or octagonal in shape, for example, depending upon the size of inlet passage 100. In addition, though internal cavity 108 in insert 104 may be illustrated as an open cavity in FIGS. 17 and 18, in other aspects, internal cavity 108 may comprise a closed cavity. (See for example, closed cavity 47 in FIGS. 3 and 4 above.)

Also, as shown in FIGS. 17 and 18, insert 104 may include one or more recesses 178 or projections 179 in peripheral surface 105, for example, recesses or projections in body that corresponding to related recesses or projections in penetration or through hole 94 in panel or wall 96. As shown in FIG. 17, insert 104 may have a recess 178 comprising a shoulder, or insert 104 may have a projection 179 from the main portion or body of insert 104. Other recesses and/or projections that, for example, are adapted to mate with corresponding recesses and/or projections in through hole 94 will be apparent to those of skill in the art.

Insert 104 may be fabricated from any appropriate material, while still providing the function disclosed herein. For example, insert 104 may be fabricated from a metal, a plastic, a rubber, or even wood. However, in one aspect of the invention, insert 104 may preferably be fabricated from a plastic foam, for example, a polystyrene foam. The polystyrene foam may have a broad range of densities, for example, from about 1 pcf to about 4 pcf, but may typically comprise a density of about 1.5 pcf.

As shown in FIGS. 17 and 18, insert 104 may have a height 173, a width 174, and a thickness 175, and internal cavity 108 may have a height 176 and a width 177. According to aspects of the invention, insert 104 may have a height 173 ranging from about 3 inches to about 36 inches, but typically has a height 173 ranging from about 6 inches to about 12 inches, for example, about 8⅛ inches. Insert 104 may have a width 174 ranging from about 3 inches to about 36 inches, but typically has a width 174 ranging from about 6 inches to about 18 inches, for example, about 12⅛ inches. Insert 104 may have a thickness 175 ranging from about ¼ inch to about 6 inches, but typically has a thickness 175 ranging from about 1 inch to about 3 inches, for example, about 2 inches. Internal cavity 108 of insert 104 may have a height 176 ranging from about 3 inches to about 24 inches, but typically has a height 176 ranging from about 4 inches to about 12 for example, about 74 inches. Internal cavity 108 may have a width 177 ranging from about 3 inches to about 24 inches, but typically has a width 177 ranging from about 4 inches to about 12 inches, for example, about 7½ inches.

It will be apparent from the foregoing that aspects of the present invention include mounting arrangements for pool skimmers, methods for mounting pool skimmers, pool skimmer adapter plates, and pool skimmer installation kits that provide unique opportunities to overcome the limitations of the prior art. For example, where prior art mounting arrangements and methods require the modification, replacement, or unique fabrication of pool panels or pools in order accommodate the varying designs of pool skimmer assemblies available on the market, aspects of the present invention may provide a single pool wall or panel having a single through hole that, regardless of the size and geometry of the skimmer assembly encountered, can be adapted to accommodate the numerous skimmer assemblies available to the pool designer and installer.

While aspects of the invention may be uniquely adapted for use with skimmers for swimming pools, for example, indoor or outdoor, in-ground, above-ground, or partially-above ground swimming pools, it is envisioned that aspects of the present invention may also be adapted for other bathing enclosures and other water-bearing enclosures, including but not limited to, spas, hot tubs, baths, tubs, showers, garden pools, fountains, water features, architectural pools, retention ponds, settling vessels, and the like.

While several aspects of the present invention have been described and depicted herein, alternative aspects may be effected by those skilled in the art to accomplish the same functions and benefits. Accordingly, it is intended by the appended claims to cover all such alternative aspects as fall within the true spirit and scope of the invention.

The invention claimed is:

1. A pool skimmer mounting arrangement comprising:

an external adapter plate adapted to mount directly on an external surface of an insulated pool wall about a penetration in the insulated pool wall, the insulated pool wall having opposing sides and internal insulation, the external adapter plate having an internal cavity substantially narrower in width than a width of the penetration in the insulated pool wall and sized to receive an inlet of a pool skimmer assembly passing through the internal cavity, and the external adapter plate having a plurality of through holes positioned to receive a plurality of mechanical fasteners; and an internal adapter plate adapted to mount on an internal surface of the insulated pool wall about the penetration in the insulated pool wall, the internal adapter plate having an internal cavity positioned to at least partially align with an inlet opening of the inlet of the pool skimmer assembly and a plurality of through holes positioned to receive the plurality of mechanical fasteners;

wherein, when mounted to the insulated pool wall with the plurality of mechanical fasteners positioned in the plurality of through holes of the external adapter plate and in the plurality through holes of the internal adapter plate, the external adapter plate and the internal adapter plate engage the opposing side walls of the insulated pool wall and the narrower internal cavity of the external adapter plate supports the inlet of the skimmer assembly within the width of the penetration in the insulated pool wall to mount the pool skimmer to the insulated pool wall.

2. The pool skimmer mounting arrangement as recited in claim 1, wherein at least one of the internal cavity of the external adapter plate and the internal cavity of the internal adapter plate comprises an open internal cavity.

3. The pool skimmer mounting arrangement as recited in claim 1, wherein the internal cavity of the internal adapter plate is adapted to completely align with the opening of the inlet of the pool skimmer assembly.

4. The pool skimmer mounting arrangement as recited in claim 1, wherein the pool skimmer mounting arrangement comprises a swimming pool skimmer mounting arrangement.

5. The pool skimmer mounting arrangement as recited in claim 1, wherein the plurality of through holes in the external adapter plate comprise a plurality of elongated through holes, wherein the elongated through holes are elongated in a direction of an arc of the external surface of the pool.

6. The pool skimmer mounting arrangement as recited in claim 5, wherein the elongated through holes comprise a major axis at least 20% greater than a minor axis.

7. The pool skimmer mounting arrangement as recited in claim 1, wherein the mounting arrangement further comprises an insert adapted to be received by the penetration in the insulated pool wall.

8. The pool skimmer mounting arrangement as recited in claim 7, wherein the insert comprises a main body having an internal cavity adapted to at least partially align with the inlet of the pool skimmer assembly and a peripheral surface adapted to be received by an internal surface of the penetration in the insulated pool wall.

9. The pool skimmer mounting arrangement as recited in claim 1, wherein the pool wall comprises a thickness, and wherein the penetration extends through the internal insulation and the thickness of the pool wall.

10. The pool skimmer mounting arrangement as recited in claim 9, wherein the internally insulated pool wall has a thickness of at least ⅛ inch.

11. The pool skimmer mounting arrangement as recited in claim 10, wherein the internally insulated pool wall has a thickness of at least 1 inch and at most 3 inches.

12. A pool skimmer installation kit comprising:

an external adapter plate adapted to mount directly on an external surface of an insulated pool wall about a penetration in the insulated pool wall, the insulated pool wall having opposing sides and internal insulation, the external adapter plate having an internal cavity substantially narrower in width than a width of the penetration in the insulated pool wall and sized to receive and support an inlet of a pool skimmer assembly passing through the internal cavity and the external adapter plate having a plurality of through holes;

an internal adapter plate adapted to mount on an internal surface of the insulated pool wall about the penetration in the insulated pool wall, the internal adapter plate having an internal cavity positioned to at least partially align with an inlet opening of the inlet of the pool skimmer assembly and a plurality of through holes; and a plurality of fasteners, each of the plurality of fasteners adapted to pass through the insulated pool wall and engage the plurality of through holes in the external adapter plate and engage the plurality of through holes in the internal adapter plate, and when the plurality of fasteners are fastened, to compress the external adapter plate and the internal adapter plate against the opposing side walls of the insulated pool wall where the narrower internal cavity of the external adapter plate supports the inlet of the skimmer assembly within the penetration in the insulated pool wall and retain the pool skimmer on the insulated pool wall.

13. The pool skimmer installation kit as recited in claim 12, wherein the kit further comprises at least one sealing device.

14. The pool skimmer installation kit as recited in claim 12, wherein the kit further comprises installation instructions.

15. The pool skimmer installation kit as recited in claim 12, wherein the mounting arrangement further comprises an insert adapted to be received by the penetration in the insulated pool wall.

16. The pool skimmer installation kit as recited in claim 15, wherein the insert comprises a main body having an internal cavity adapted to at least partially align with the inlet of the pool skimmer assembly and a peripheral surface adapted to be received by an internal surface of the penetration in the insulated pool wall.

17. A pool skimmer mounting arrangement comprising:

an external adapter plate adapted to mount directly on an external surface of an insulated pool wall about a penetration in the insulated pool wall, the insulated pool wall having opposing sides and internal insulation, the external adapter plate having an internal cavity substantially narrower in width than a width of the penetration in the insulated pool wall and sized to receive an inlet of a pool skimmer assembly passing through the internal cavity, and the external adapter plate having a plurality of through holes positioned to receive a plurality of mechanical fasteners;

an internal adapter plate adapted to mount on an internal surface of the insulated pool wall about the penetration in the insulated pool wall, the internal adapter plate having an internal cavity positioned to at least partially align with an inlet opening of the inlet of the pool skimmer assembly and a plurality of through holes positioned to receive the plurality of mechanical fasteners; and an insert adapted to be received by the penetration in the insulated pool wall, wherein the insert comprises a main body having an internal cavity adapted to at least partially align with the inlet of the pool skimmer assembly and a peripheral surface adapted to be received by an internal surface of the penetration in the insulated pool wall;

wherein, when mounted to the insulated pool wall with the plurality of mechanical fasteners positioned in the plurality of through holes of the external adapter plate and in the plurality through holes of the internal adapter plate, the external adapter plate and the internal adapter plate engage the opposing side walls of the insulated pool wall and the narrower internal cavity of the external adapter plate supports the inlet of the skimmer assembly within the width of the penetration in the insulated pool wall to mount the pool skimmer to the insulated pool wall.

* * * * *